United States Patent [19]

Rones

[11] Patent Number: 4,502,174

[45] Date of Patent: Mar. 5, 1985

[54] POLISHING PAD

[75] Inventor: James M. Rones, Atlanta, Ga.

[73] Assignee: Land Industries, Acworth, Ga.

[21] Appl. No.: 452,553

[22] Filed: Dec. 23, 1982

[51] Int. Cl.[3] ..... B24B 29/00; A47L 11/14

[52] U.S. Cl. ..... 15/98; 15/230; 15/230.16

[58] Field of Search ..... 15/97 R, 98, 230, 230.1, 15/230.14, 230.15, 230.16, 230.17, 230.18, 230.19; 51/170 T, 209 R, 395

[56] References Cited

U.S. PATENT DOCUMENTS 3,183,542 5/1965 Anders ..... 15/98
3,793,665 2/1974 Thielen ..... 15/98 X
4,307,480 12/1981 Fallen ..... 15/230.18

FOREIGN PATENT DOCUMENTS 1103181 3/1961 Fed. Rep. of Germany .... 51/170 T

*Primary Examiner*—Edward L. Roberts
*Attorney, Agent, or Firm*—Sughrue, Mion, Zinn, Macpeak and Seas

[57] ABSTRACT

A polishing pad is provided having a diameter substantially equal to the diameter of a conventional electric floor polishing machine. A center aperture is provided in the pad whereby the pad may be secured to the floor polisher in a well-known manner. A plurality of apertures are provided in the pad eccentrically of the central aperture whereby the surface area of the pad is reduced thereby reducing drag on the machine which results in reduction of the current drawn with the consequent reduction in overheating and the blowing of fuses.

4 Claims, 5 Drawing Figures

POLISHING PAD

BACKGROUND OF THE INVENTION

1. Field of the Invention

This invention pertains to polishing pads of the type used with electric floor polishing machines.

2. Statement of the Prior Art

The prior art shows polishing pads for use with electric floor polishing machines. These pads have central apertures whereby the pads may be attached to the polishing machine. None of the prior art shows a polishing pad having a reduced surface area by means of a plurality of apertures positioned eccentrically about the central aperture. Representative of the prior art are the following U.S. patents.

| Patentee | U.S. Pat. No. | Issue Date |
|---|---|---|
| W. F. Galey | 2,757,491 | Aug. 7, 1956 |
| H. G. Hencken | 3,164,855 | Jan. 12, 1965 |
| H. G. Hencken | 3,243,833 | April 5, 1966 |
| Magid | 4,176,420 | Dec. 4, 1979 |

SUMMARY OF THE INVENTION

A polishing pad for use with a floor polishing machine is needed whereby severe drag on the machine will be reduced thus reducing current flow and overheating of machine which resulted in the blowing of fuses frequently.

It is therefore one object of this invention to provide a polishing pad which will function to provide a sufficient polishing surface yet will be effective to reduce the drag on an electric floor polishing machine.

It is another object of this invention to provide a polishing pad having a reduced surface area whereby less drag will be created on the floor polishing machine thus reducing overheating of the machine.

It is yet another object of this invention to provide a disc-like polishing pad for use with an electric floor polishing machine having a uniform diameter yet having a reduced surface area.

It is still another object of this invention to provide a disc-like polishing pad for use with an electric floor polishing machine having a plurality of apertures in the surface thereof thus reducing the surface area of the pad yet providing sufficient surface area to effect optimum polishing of a floor or other surface.

An yet another object of this invention is to provide a polishing pad for use with an electric floor polishing machine having a plurality of apertures in the surface thereof, said apertures arranged eccentrically of the central aperture in the pad surface.

These and other objects of this invention will become apparent to those skilled in the art to which this invention pertains from a reading of the specification when taken in view of the annexed drawings.

DESCRIPTION OF THE PREFERRED EMBODIMENT

Figure 1:
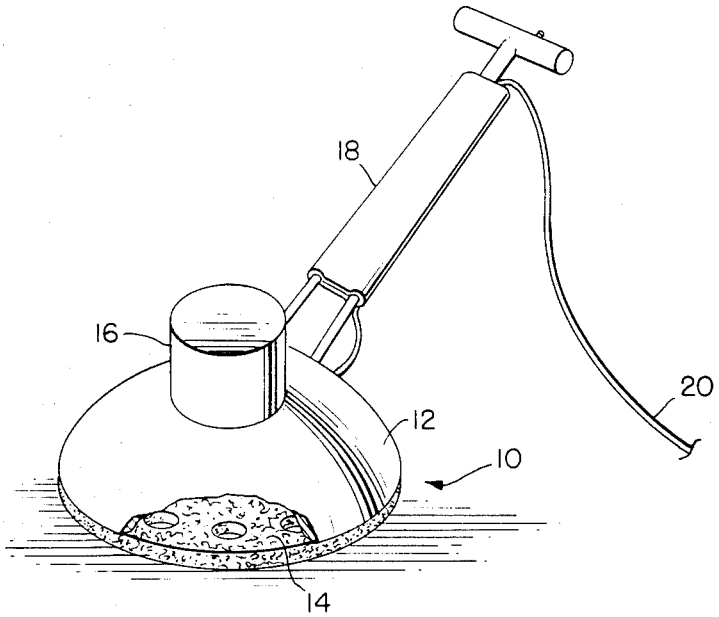
FIG. 1 is a perspective view, partially cutaway showing an electric floor polishing machine with the pad of this invention secured to the machine in a well-known manner.
Figure 2:
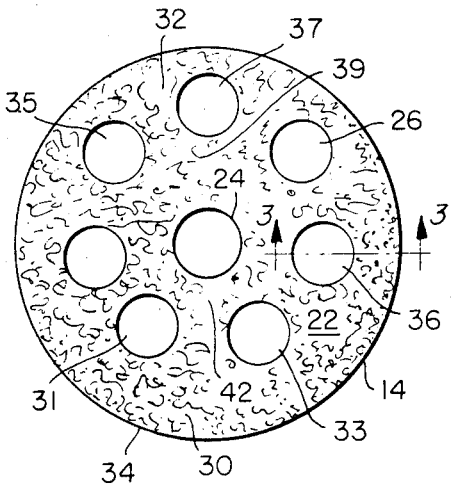
FIG. 2 is a plan view of the pad showing a plurality of circular apertures therein.

Referring in more detail to the drawings, FIG. 1 shows an electric floor polishing machine 10 having a polishing pad supporting member 12, a polishing pad 14 secured to the supporting member, a motor 16, a handle 18 and an electric cord 20 which connects the motor to a source of electric power.

The pad 14 is disc-like in configuration having a diameter approximately equal to the diameter of the polishing machine supporting member 12. The pad 14 is constructed of porous fibrous material 22 such as fiberglass or the like. Thus constructed, the pad 12 is durable, flexible and compressible.

The pad 14 has a thickness of about 1" and has a central aperture 24 for receiving a boss (not shown) on the support 12 whereby the pad 14 is secured to the member 12. A plurality of circular apertures 26 are cut in the surface of the pad 14 thus reducing the surface area thereof. The apertures 26 are typically 2" in diameter, however, they may be smaller or larger depending on the amount of surface area needed to provide optimum polishing of any surface. The apertures 26 are arranged about the surface of the pad 14 in an eccentric fashion with greater surface area at 30 between apertures 31 and 33 and the periphery 34 and lesser surface area at 32 between apertures 36 and 37 and the periphery 34. Because of the eccentric arrangement of the various apertures, the surface area 39 between the central aperture 24 and the apertures 26, 35 and 37 is greater than the surface area 42 between the aperture 24 and the apertures 31, 33 and 36.

A reduction in the surface area of the pad is very important due to the significant reduction of drag on the polishing machine. The reduction in drag results in significant reduction in the current drawing from the power source thus reducing the tendency to blow fuses and the tendency of the machine to overheat and cease. This down time is wasteful both as to the operation of the machine including burnt out parts as well as wasteful of man hours.

Conventional pads are inadequate because of the tendency to increase drag on the machine which results in drawing more power than the fuse or fuses is capable of handling. Overheating of the machine also results with a loss of efficiency and man hours.

Figure 4:
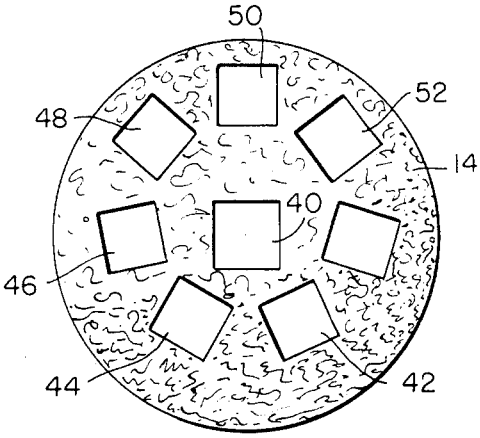
FIG. 4 is a plan view of the pad showing a plurality of square apertures therein.
Figure 3:
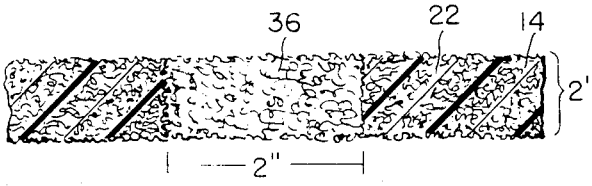
FIG. 3 is a view of the pad taken along the line 3—3 of FIG. 2.

FIG. 4 shows a polishing pad 14 with a central square aperture 40 and an arrangement of eccentric square apertures 42–52. Rectangular apertures could also be used.

Figure 5:
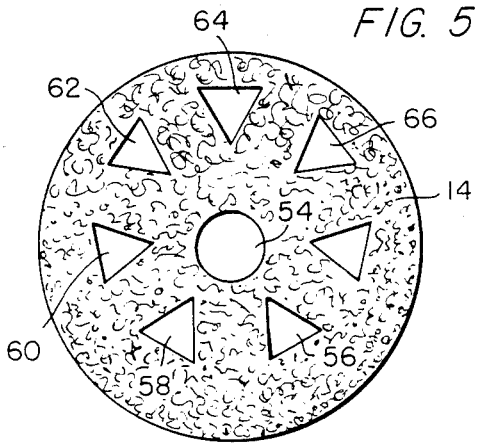
FIG. 5 is a plan view of the pad showing a plurality of triangular apertures therein.

FIG. 5 shows a polishing pad 14 having a central opening 54 and a plurality of triangular eccentrically arranged apertures 56–66.

While the invention has been shown and described in detail with reference to a preferred embodiment thereof, it will be understood to those skilled in the art to which this invention pertains that various changes in form and detail may be made therein without departing from the spirit and scope of the invention.

What I claim is:

1. In combination with a floor polishing machine having an electric motor, a handle and a polishing pad support, the improvement comprising:

a polishing pad of fibrous material having a central aperture for receiving means on the machine for attaching the pad to a polishing pad support;

a plurality of apertures in the surface of the pad near the periphery thereof and remote from the central aperture;

said plurality of apertures being eccentric about and remote from the central aperture;

a first floor contact area between the central aperture the plurality of apertures;

a second floor contact area between said plurality of apertures;

a third contact area between the plurality of apertures and the periphery of the pad; and said plurality of apertures for receiving the surface area of the pad thereby reducing the drag on the machine whereby the amount of current drawn drops from 16 amps to 12 amps whereby over-heating and blown fuses are substantially eliminated.

2. In combination with a floor polishing machine as defined in claim 1, wherein:

said central aperture being either circular, square, rectangular or triangular.

3. In combination with a floor polishing machine as defined in claim 1, wherein:

said plurality of apertures being either circular, square, rectangular or triangular.

4. In combination with a floor polishing machine as defined in claim 1, wherein:

the surface of the pad between at least two of the apertures and the central aperture being greater than the surface area of the pad between any other apertures and the central aperture.

* * * * *